United States Patent [19]

Masciantonio et al.

[11] 4,094,746

[45] June 13, 1978

[54] COAL-CONVERSION PROCESS

[75] Inventors: Philip X. Masciantonio, Penn Township, Westmoreland County; Kenneth A. Schowalter, Monroeville Borough, both of Pa.

[73] Assignee: United States Steel Corporation, Pittsburgh, Pa.

[21] Appl. No.: 526,481

[22] Filed: Nov. 25, 1974

Related U.S. Application Data

[63] Continuation of Ser. No. 205,248, Dec. 6, 1971, abandoned.

[51] Int. Cl.[2] ..... C10B 49/16; C10B 55/02

[52] U.S. Cl. ..... 201/5; 201/12; 201/22; 201/23; 201/31

[58] Field of Search ..... 201/5, 6, 9, 17, 23, 201/31, 26, 29, 36, 21, 22, 12; 208/8-10; 423/461

[56] References Cited

U.S. PATENT DOCUMENTS

| | | | |
|---|---|---|---|
| 2,595,366 | 5/1952 | Odell | 201/17 |
| 2,955,988 | 10/1960 | Sebastian | 201/31 |
| 3,562,783 | 2/1971 | Gorin | 201/6 |
| 3,700,583 | 10/1972 | Salamony | 208/8 |
| 3,705,092 | 12/1972 | Gatsis | 208/8 |
| 3,884,796 | 5/1975 | Hinderliter | 208/8 |

*Primary Examiner*—Hiram H. Bernstein
*Attorney, Agent, or Firm*—Arthur J. Greif

[57] ABSTRACT

This invention is directed to a process for converting coal into useful liquids, solids, and gases, by combined processes of coal carbonization and liquefaction in which the carbonization reaction yields hydrogen suitable for the liquefaction. The heavy liquid products from the liquefaction and the carbonization may be combined with the solid char to form a metallurgical coke. Other liquids may be treated and converted into useful industrial hydrocarbon chemicals. The gases from the combined reactions yield a fuel gas as well as a hydrogen stream suitable for use in the overall processing.

7 Claims, 9 Drawing Figures

COAL-CONVERSION PROCESS

This is a continuation of application Ser. No. 205,248, filed Dec. 6, 1971, now abandoned.

BACKGROUND OF THE INVENTION

There is a need to find processes which can convert coal into metallurgical coke and hydrocarbon liquids of such economic value that the overall process can compete with traditional methods of coke making such as the high temperature carbonization of metallurgical coal. This invention is particularly concerned with high sulfur coal and a means by which this coal can be economically converted into metallurgical coke. Another aspect of this invention is to provide supplementary energy and material resources for the production of fuel gas, liquid fuels, chemicals and metallurgical coke.

OBJECTS OF THE INVENTION

It is among the objects of this invention to provide a method for converting coal into useful gases such as hydrogen and fuel gas; liquids, such as aromatics; and solids such as metallurgical grade coke by the chemical conversion of coal. It is a further object of this invention to perform this conversion of coal under such conditions that minimize the need for external energy and material and maximize the production of useful gases, liquids, and solids. Specific objects of this invention include the conversion of high sulfur coal so that metallurgical grade coke, fuel gas, hydrogen and benzenoid hydrocarbons may be obtained; performing this conversion by carbonization and liquefaction processes without the need for external catalysts; performing the carbonization at a low temperature and in a fluidized bed; performing the carbonization under a desulfurizing hydrogen atmosphere substantially free of air or oxygen; providing combinations and subcombinations of product streams as feed streams in the liquefaction or carbonization processes so that low value, heavy hydrocarbon residues are consumed within the overall coal conversion process. A further object of the invention is to control the kinds and quantities of useful gases, and solids obtained by conversion of coal through selecting conditions and proportions of feeds to the liquefaction and carbonization processes as well as by selecting treatments for refining the products obtained from the carbonization and liquefaction processes.

In general, the invention involves preparing a mined coal of high sulfur and ash content by washing and screening, then subjecting a fraction of it to liquefaction while subjecting another selected fraction to carbonization and desulfurization in fluid bed reaction processes under a desulfurizing atmosphere of hydrogen without the presence of air or oxygen. The hydrogen produced in the carbonization may be used as the source of hydrogen for the liquefaction while other product streams can be recycled to the liquefaction or carbonization processes.

DETAILED DESCRIPTION OF THE INVENTION

In the process of this invention, coal is mined and washed to reduce its ash content. Thereafter, a portion is subjected to liquefaction, most commonly coal hydrogenation. The remainder is subjected to desulfurization and carbonization. The gas, liquid and solid products are then treated so that they may provide recycle streams, the ultimate process products and to remove wastes. In the following, the overall process and each of the individual process steps are described. The preferred practice of the invention is described by recourse to the preferred kinds of process steps and the operating conditions for these steps.

Figure 1:
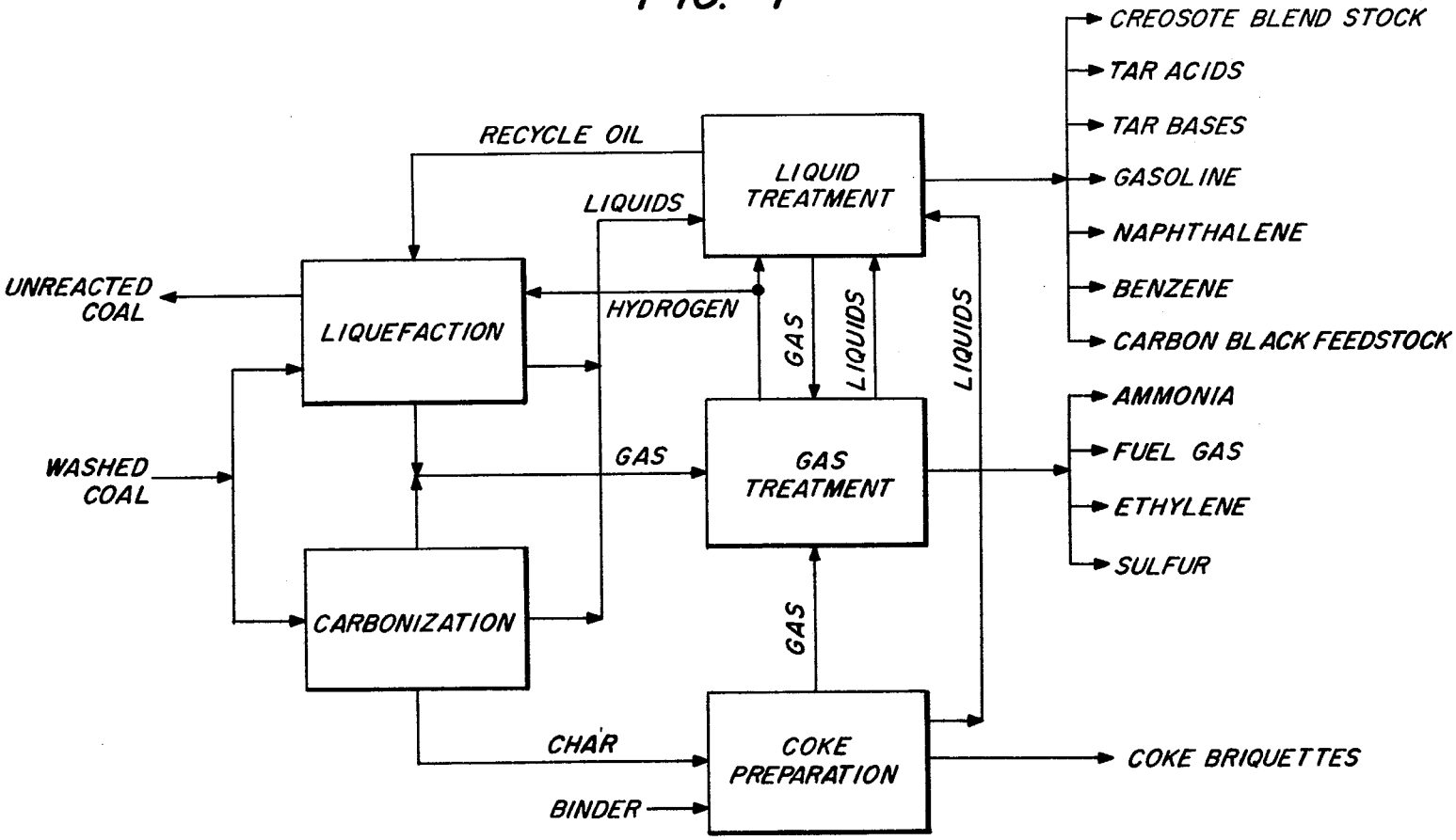
FIG. 1 is a flow diagram illustrating the conversion of coal into useful liquids, solids, and gases according to the invention.

FIG. 1 illustrates the overall process of the invention from the feeding of the washed coal to the liquefaction and carbonization processes through the preferred methods for production of the hydrocarbon liquids and gases and metallurgical coke materials.

High ash mined coal is washed and screened. The coal may have the following composition:

| | As Mined | Washed |
|---|---|---|
| Fixed Carbon | 43.5 | 50.5 |
| Volatile Matter | 31.0 | 36.0 |
| Moisture | 8.5 | 8.5 |
| Ash | 17 | 5.0 |

The elemental balance after washing is:

| Component | Weight Percent | Weight Percent MAF |
|---|---|---|
| Carbon | 62.7 | 72.6 |
| Hydrogen | 5.4 | 6.2 |
| Sulfur | 1.9 | 2.2 |
| NItrogen | 1.6 | 1.8 |
| Oxygen | 14.9 | 17.2 |
| Ash | 5.0 | — |
| Free Moisture | 8.5 | — |

This coal is then split into selected fractions that enter the carbonization unit and the coal liquefaction unit. The ratio of coal to liquefaction and to carbonization is a means by which the hydrogen requirement of the overall process can be controlled. As well, the distribution of products obtained from the coal is also affected by this ratio as is explained later. In the coal liquefaction unit, coal may be slurried with recycle oil and hydrogenated under non-catalytic conditions at a temperature between 800° and 960° F and at pressures of from 2,000 to 10,000 psia. The hydrogen required for this operation may be obtained wholly from the low temperature carbonization process, which hydrogen has been purified by treatment of effluent gases. The products obtained from liquefaction may be separated from the unreacted coal by conventional means. A particularly advantageous means is a vaporization process. Subsequent cooling and condensation of the liquefaction products yield hydrocarbon liquids and gases and recycle material. As is well known, liquefaction is basically a process in which hydrogen is added to the initial coal to form hydrocarbon liquids of higher values than the original coal materials.

The carbonization section may have a fluidized bed carbonizer in which the volatile matter content of the coal is reduced from 36 to 15% at pressures from atmospheric up to 300 psia and temperatures of up to about 1600° F. Carbonization takes place in a hydrogen-rich atmosphere which desulfurizes the coal and results in a low sulfur char which is sent to the coke preparation area. The gases from the carbonizer are cooled to separate condensable tars; a selected fraction may have its hydrogen sulfide removed for recycle back to the carbonizer and the remaining gases and liquids can be sent to the liquid treatment and gas treatment areas.

Gases from the liquefaction and carbonization sections as well as other liquid treatment sections in the coke preparation areas may be combined into a common stream to the gas treatment section. This section provides for the recovery of ammonia, a low temperature separation of the gases, the condensation of light oils, an ethylene plant, a Claus plant, a carbon monoxide shift converter, and carbon dioxide scrubbers. As shown in the diagram, the gas treatment section can produce ethylene, sulfur, ammonia, fuel gases, and a purified hydrogen stream available for recycle to other treating areas in the overall process, particularly the initial liquefaction reactor and the hydrogenation processes occurring in the liquid treatment area.

Liquids obtained from the carbonization section, the liquefaction section, the gas treatment section, and the coke preparation section areas are sent to the liquid treatment section. Here the liquids are distilled to yield oils and heavy oils. Tar acids and tar bases may be recovered by extraction units; reforming and solvent extraction can produce gasoline; hydrocracking and dealkylation will convert alkyl aromatics to benzene and naphthalene. Further distillation units can produce highly purified benzene and naphthalene. If desired, a fluidized bed coking unit may be used to convert heavy hydrocarbon oil bottoms into fluid coke and oil. Other hydrocarbon oils obtained from the liquid treatment section may be recycled for use in forming coal slurries in the coal liquefaction or for binders in coke preparation.

The coke preparation unit may be used to convert the low sulfur char into metallurgical coking materials by blending it with hydrocarbon oils obtained from the liquid treatment section. The green metallurgical coke materials can be carbonized at 1000° F or above to yield a metallurgical grade of coke product.

In the overall process, most of the energy can be provided by expanding steam obtained from hot streams in the liquid and gas treatment sections. Waste coal streams from the initial washing of the coal as well as materials obtained as solid residues from liquefaction can be used as a solid fuel for the production of electrical power.

Based on an annual rate of 10,000,000 tons (MAF) coal, of a composition as previously described, or a feed rate of 11.53 million tons per year of 5% ash coal containing 8.5% moisture, the products illustrated in Table I can be produced by the practice of the invention.

Table I

| Products | Annual Production | |
|---|---|---|
| Ammonia | 138 | M tons |
| Sulfur | 182 | M tons |
| Ethylene | 1202 | MM pounds |
| Benzene | 188 | MM gallons |
| Naphthalene | 220 | MM pounds |
| Gasoline | 70.1 | MM gallons |
| Carbon Black Feedstocks | 12.6 | MM gallons |
| Metallurgical Grade Coke | 4.05 | MM tons |
| Phenol | 192.0 | MM pounds |
| Ortho-cresol | 70.6 | MM pounds |
| Meta-, para-cresol | 277 | MM pounds |
| Mixed Xylenol | 277 | MM pounds |
| Pyridine | 27.0 | MM pounds |
| a-Picoline | 11.2 | MM pounds |
| Aniline | 98.7 | MM pounds |
| Creosote Blend Stock | 8.48 | MM pounds |
| **By-Products** | **Annual Production** | |
| Fuel Gas (net) | 12,354,000 MM Btu | |
| Steam Coal (net) | 63,531,000 MM Btu | |
| (15% ash, 8.5% moisture) | (2.83 MM tons) | |
| Unconverted Coal (36% ash) | 13,347,000 MM Btu | |
| | (0.756 MM tons) | |

As was described above, the ratio of coal subjected to carbonization to that coal subjected to liquefaction affects the quality of the coke as well as the products obtained in the form of useful liquids and gases. On the basis of 10 million tons MAF coal, Table II illustrates the effect of changes in the carbon, hydrogen, nitrogen, sulfur, oxygen and ash analysis of coal upon the product mix as well as the effect of the fraction of coal being carbonized upon the product mix.

Table II

| Coal | Illinois Coal Orient No. 3 | Illinois Coal No. 6 Franklin County | Pittsburgh Seam |
|---|---|---|---|
| Rank | Medium | Medium | High |
| Coal Analysis (wt. %) | | | |
| Carbon | 72.0 | 62.8 | 78.7 |
| Hydrogen | 5.3 | 5.4 | 5.4 |
| Nitrogen | 1.8 | 1.6 | 1.5 |
| Sulfur | 2.0 | 1.9 | 1.25 |
| Oxygen | 11.0 | 14.8 | 7.1 |
| Ash | 7.9 | 5.0 | 6.1 |
| Ratio of Coal to Carbonizer | 0.43 | 0.53 | 0.35 |
| Coke Yield (ton) MM tons | 4.4 | 4.1 | 2.8 |
| Benzene (lb) MM lbs | 1200 | 1400 | 2100 |
| Ethylene | 1700 | 1150 | 3050 |
| Tar Acid | 1000 | 830 | 780 |
| Gasoline | 400 | 500 | 1710 |
| Sulfur | 250 | 350 | 160 |
| Naphthalene MM lbs | 200 | 250 | 350 |
| Ammonia | 175 | 250 | 150 |
| Tar Bases | 120 | 150 | 210 |
| Chemical Yield MM lbs | 5800 | 5400 | 7510 |

Table II-continued

| Coal | Illinois Coal Orient No. 3 | Illinois Coal No. 6 Franklin County | Pittsburgh Seam |
|---|---|---|---|
| Products* MM lbs | 14600 | 13600 | 14100 |

*Exclude fuel gas and fuel coal products.

Figure 2:
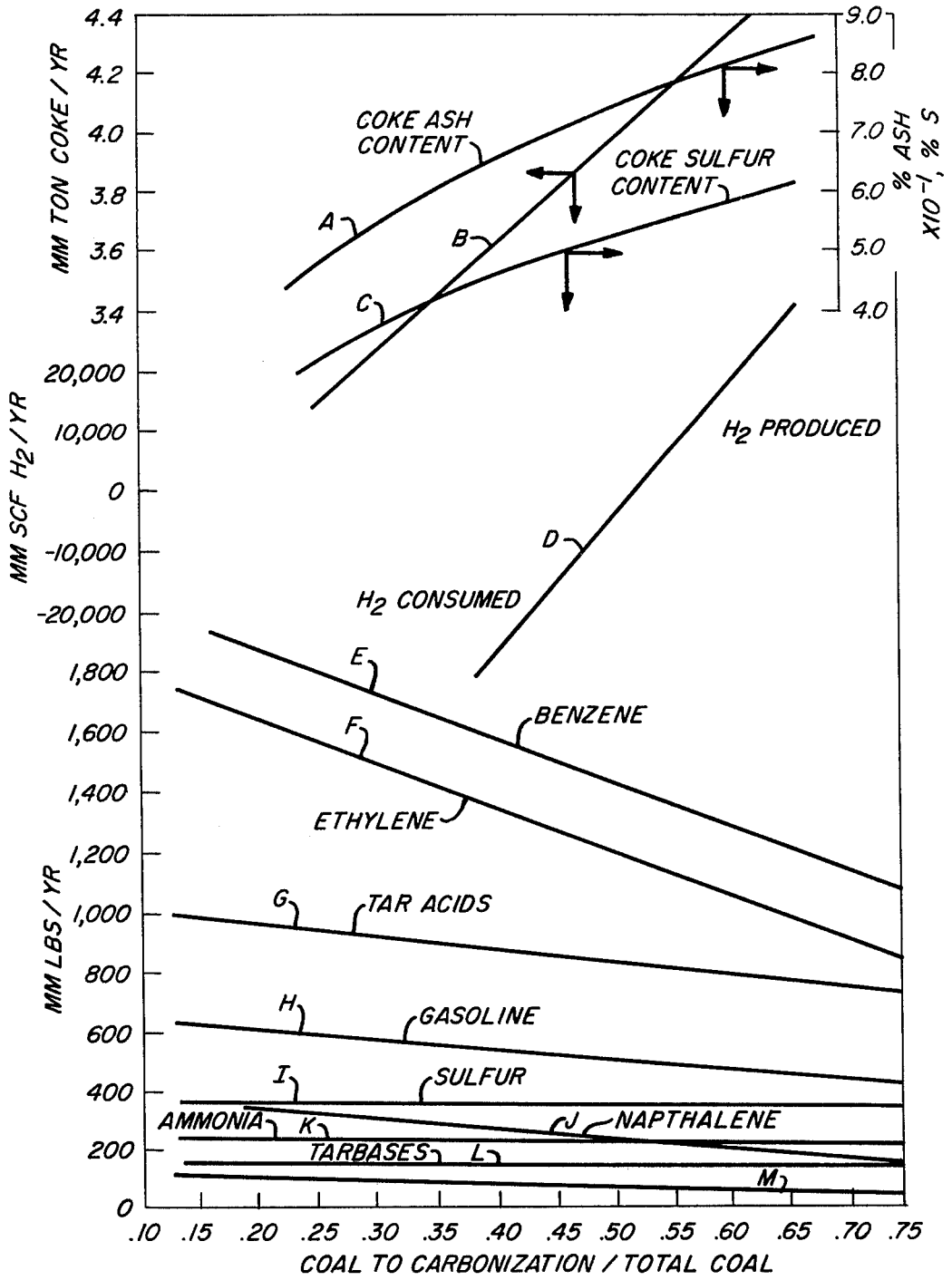
FIG. 2 illustrates the effect on the distribution of products from increasing the amount of coal subject to liquefaction relative to that being carbonized.

FIG. 2 illustrates the operating lines for the carbonization and liquefaction in the practice of the invention. Curve D on FIG. 2 illustrates the hydrogen requirement of the process as a function of the ratio of coal fed to carbonization to the total coal consumed in the process. At a ratio of about 0.53, the net hydrogen requirement of the overall process is zero, showing the process to be in hydrogen balance. Curve A of FIG. 2 illustrates the ash content of the metallurgical coke produced in the process as a function of the fraction of coal fed to the carbonization unit, Curve B illustrates the amount of coke produced as a result of this ratio, Curve C illustrates the sulfur content of the coke as a function of this ratio. Practically, metallurgical coke should have a sulfur content below 1%; preferably it will be below 0.7%, especially below 0.6% and most desirably below 0.5%. Curve E illustrates benzene production as a function of the ratio of coal fed to the carbonizer; likewise, Curves F through M illustrate the production of ethylene, tar acids, gasoline, sulfur, naphthalene, ammonia, tar bases, and carbon black feedstock as a function of this ratio. The operating range of the process is controlled by the interrelation of these various curves. For instance, the production of hydrogen increases as the ratio of coal being carbonized is increased. This production, however, is limited since the sulfur and ash content of the metallurgical coke, a desirable end product, increases to impractical levels. Moreover, as the ratio of coal being carbonized is increased, there is a decrease in the production of valuable chemical products such as benzene, ethylene, etc. From the overall economic viewpoint, therefore, a desirable operating range will be from about 0.53 to about 0.65 parts of coal to the carbonizer per part of coal consumed in the process.

The coal carbonization and desulfurization of this process is for the purpose of breaking down the coal into a solid residue primarily of carbon, called char, and into gaseous products such as hydrogen. The original sulfur is converted into hydrogen sulfide gas that may be further treated as part of the gas product stream.

Figure 3:
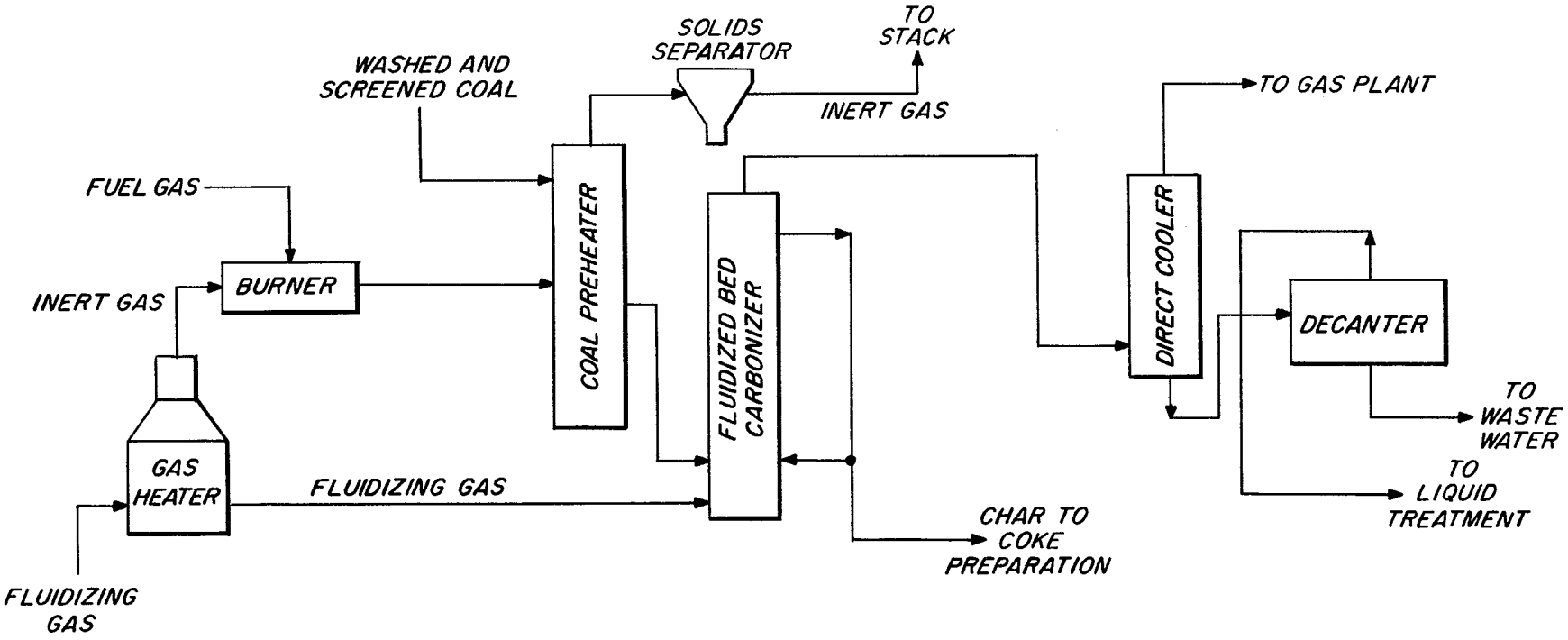
FIG. 3 is a flow diagram of a carbonization and desulfurization process according to the invention.

FIG. 3 illustrates in detail the coal carbonization and desulfurization section of the overall conversion process. The ultimate product from the carbonization reaction being primarily a mixture of gases and solid char, it is desirable that this carbonization be performed in a continuous manner and under fluidized bed conditions. Generally, the carbonization may be conducted at a temperature of about 950° F to about 1500° F. The carbonization may be performed at a pressure from about atmospheric to about 300 psig. It is important that during carbonization, the gaseous atmosphere maintained in the carbonization reaction have a hydrogen sulfide content of no more than about 2% by volume of hydrogen sulfide. Otherwise, the desulfurization which occurs during the carbonization reaction is inhibited. The carbonization reaction conditions are in part a reflection of available equipment capabilities refractory lined vessels for these operations are readily available. However, the upper temperature limit is also limited by the desire to avoid excessive cracking of the gases produced from the carbonization.

The washed coal from the coal preparation section will contain about 8.5% moisture, about 5% ash, and have a nominal particle size of a ¼ inch. For the preselected fraction that is fed into the carbonization section, a maximum particle size of ⅛ inch is especially desirable for use in fluidization processes, therefore, the feed stream is screened to provide this particle size. The screened and washed coal is first sent to a fluidized bed preheater. Here the coal is preheated by a mixture of low pressure stream and hot flue gas from the heaters for the carbonizer fluidizing gas, which steam and flue gases have been heated in a fuel gas burner. The preheaters are essentially at atmospheric pressure for convenience of transportation of the coal. The coal is preheated to about 390° F in an atmosphere that may be inert or may contain some steam. Higher temperatures of preheating, such as 570° F tend to generate acidic and noxious flue gases from the preheating section.

The dried coal is fed to the fluid bed carbonizer and desulfurizer. Carbonization and desulfurization may be at 95 psia and 950° F. However, these carbonizers may be operated at temperatures as high as 1500° F. It has also been found that the faster that the dried coal is heated to its carbonization temperature the better the desulfurization that occurs during the carbonization. While heating rates of about 16° F per minute tend to improve the fluidization performance of the fluidization process, heating rates of 144° F per minute or higher tend to give improved desulfurization in the final char product. To prevent agglomeration of the dried coal in the fluidized bed carbonizer, char product is recycled or maintained as inventory in the fluidized bed reactor. This char may be in about an equal ratio with that of the coal fed to the reactor. Lesser or greater amounts of char to coal may be used depending upon the fluidization characteristics of the coal. In addition, it has been found that heavy oils obtained from the processing of the gas and liquid products of the liquefaction and carbonization processes may, if desired, be recycled back to the carbonization reaction. These heavy oils in the carbonization reactor tend to form additional char and at the same time yield lighter hydrocarbon oils.

The fluidization gases for the fluidized bed carbonizer are hydrogen rich. This promotes the desulfurization of the high sulfur coal in the carbonization process. The fluidization gases must contain at least sufficient amounts of hydrogen to react with sulfur in the coal to form $H_2S$ and yield a char having less than 1% by weight of sulfur. The gas itself may have a hydrogen concentration ranging from about 20 mol percent to 100 mol percent; especially at higher pressures, 90 - 300 psi, the hydrogen concentration may be about 20 mol percent. This hydrogen rich fluidization gas may be obtained from carbonizer off gases that have had their hydrogen sulfide content reduced to less than about 2% hydrogen sulfide by volume. These gases may be heated in the indirect gas fired heaters, and injected into the bottom of the carbonizers. The fluidizing gas may contain moisture carried over from hydrogen sulfide removal by contacting the gas with aqueous carbonate solution. This moisture also tends to improve the desulfurization of the coal in the carbonization section.

The char leaving the carbonization section may be continuously cooled by water quenching and then conveyed to the coke preparation section where it will be made into green metallurgical coking material. This char desirably has a sulfur content less than 0.6 percent in order that a satisfactory metallurgical coke can be produced from the green product. The gases leaving the carbonization sections may be cooled by water injection and also through a direct cooler. The cooled gas which may be at about 100° F is then sent to the gas treatment section. Tars and light oils condensed from the direct cooling may be sent to the liquid treatment section. Fluid bed carbonization and desulfurization may have a 90-minute residence time, a 50% char recycle or inventory, and a volatile matter content of the char leaving the carbonizer of about 15%.

Figure 5:
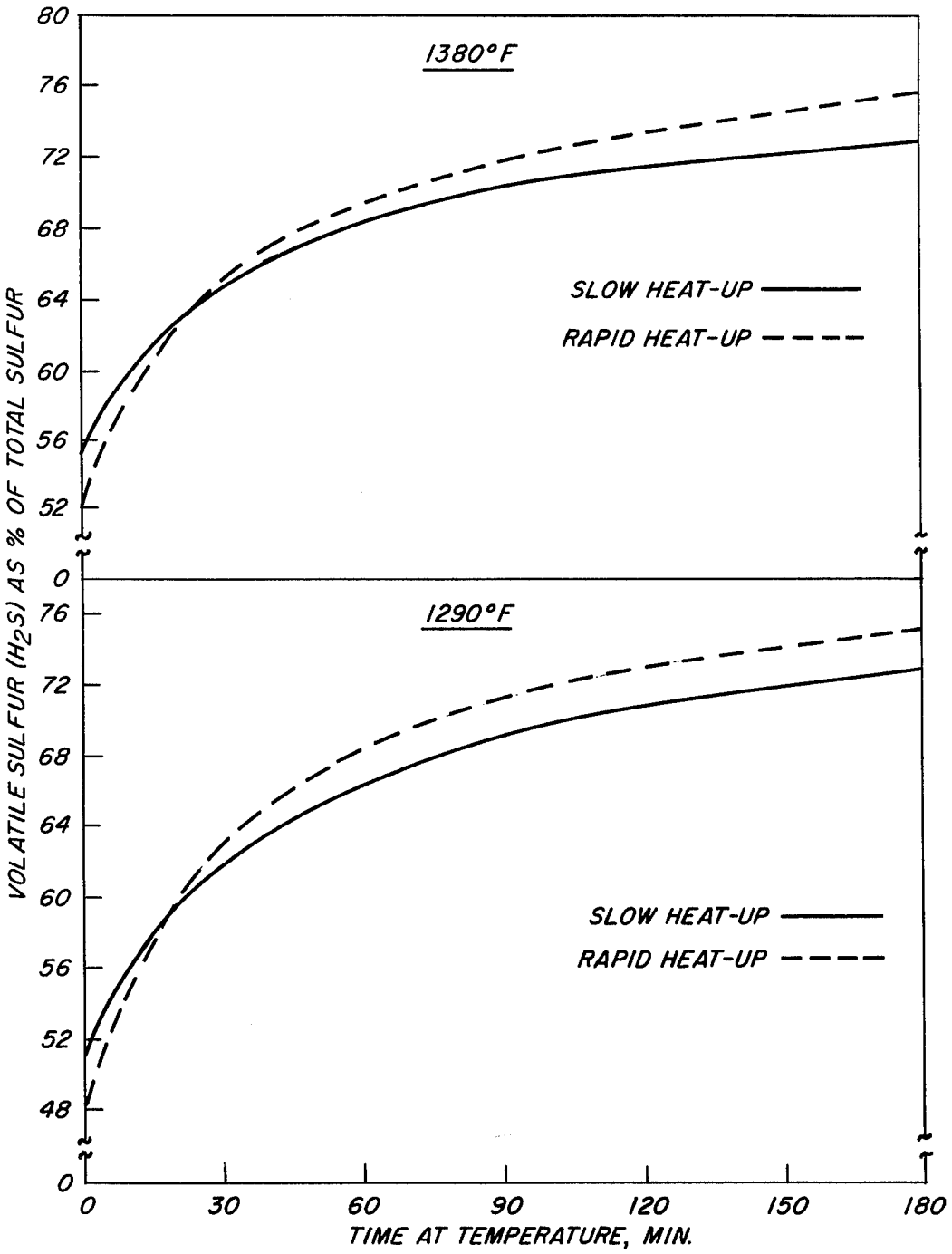
FIG. 5 illustrates the effect of rate of temperature increase on residual sulfur content of char in a process as described in FIG. 3.

It has been found that as the rate at which the coal/-char mixture is heated up to the carbonization temperature is increased, the rate of desulfurization will be increased. Table IV illustrates this effect upon a charge of 100% coal. FIG. 5 illustrates this effect upon a charge of 50% coal/50% char (0.52% S). Again, it can be seen that the improvement is greater for the mixture of char and coal than for coal alone.

The preferred temperatures of carbonization and desulfurization are from about 900° to 1600° F, especially about 1250° to 1550° F. In addition, the drying of the coal prior to carbonization and desulfurization is most advantageously performed at about 300° to 400° F, about 380° to 400° F is preferred.

This carbonization and desulfurization applies especially to high ash and high sulfur coals having about 5 to 15 percent by weight of ash and about 1 to 5 percent by weight of sulfur.

Table IV

| | Effect of Heat-Up Rate | | | | | |
|---|---|---|---|---|---|---|
| | 1200° F | | 1290° F | | 1380° F | |
| Conditions | Slow | Rapid | Slow | Rapid | Slow | Rapid |
| Coal Char, weight percent | 100 | 100 | 100 | 100 | 100 | 100 |
| Fluidizing Gas | $H_2$ | $H_2$ | $H_2$ | $H_2$ | $H_2$ | $H_2$ |
| Bed Condition | 80% free flowing | agglomerated | 80% free flowing | agglomerated | 80% free flowing | agglomerated |
| Heat-up Rate, ° F/min. | 16[a] | 139[b] | 16[a] | 140[b] | 16[a] | 144[b] |
| Residence Time, min. | 180 | 180 | 180 | 180 | 180 | 180 |
| Material Balance | | | | | | |
| Char, weight percent | 64.0 | 61.6 | 62.4 | 60.0 | 61.6 | 59.2 |
| Tar, weight percent | 16.0 | 25.6 | 15.6 | 20.0 | 14.4 | 23.2 |
| Gas + loss, weight percent | 20.0 | 12.8 | 22.0 | 20.0 | 24.0 | 17.6 |
| Sulfur Analysis | | | | | | |
| Coal, weight percent | 2.0 | 2.0 | 2.0 | 2.0 | 2.0 | 2.0 |
| Char, weight percent | 0.62 | 0.50 | 0.52 | 0.38 | 0.52 | 0.34 |

[a]Rate from 570° F to bed temperatue.
[b]Rate from 400° F to bed temperature.

The operating temperature and rate of heat-up in the carbonizer is selected from the effects the temperature and heat-up rate has on coal desulfurization and the fluidization characteristics of the material subject to the carbonization. It has been found that temperatures up to about 1600° F increased the desulfurization of the char. This is shown in Table III as follows.

Table III

| | Effect of Temperatures Higher Than 1150° F | | | |
|---|---|---|---|---|
| Conditions | 1200° F | 1290° F | 1380° F | 1470° F |
| Coal Charge, wt. % | 100 | 100 | 100 | 100 |
| Fluidizing Gas | $H_2$ | $H_2$ | $H_2$ | $H_2$ |
| Bed Condition | 80% free flowing | 80% free flowing | 80% free flowing | 80% free flowing |
| Heat-up rate of min | 16 | 16 | 16 | 16 |
| Residence Time, min | 180 | 180 | 180 | 180 |
| Material Balance | | | | |
| Char, wt. % | 64.0 | 62.4 | 61.6 | 61.2 |
| Tar, wt. % | 16.0 | 15.6 | 14.4 | 16.0 |
| Gas & Loss, wt. | 20.0 | 22.0 | 24.0 | 22.8 |
| Sulfur Analysis | | | | |
| Coal, wt. % | 2.0 | 2.0 | 2.0 | 2.0 |
| Char, wt. % | 0.62 | 0.52 | 0.52 | 0.52 |

Figure 4:
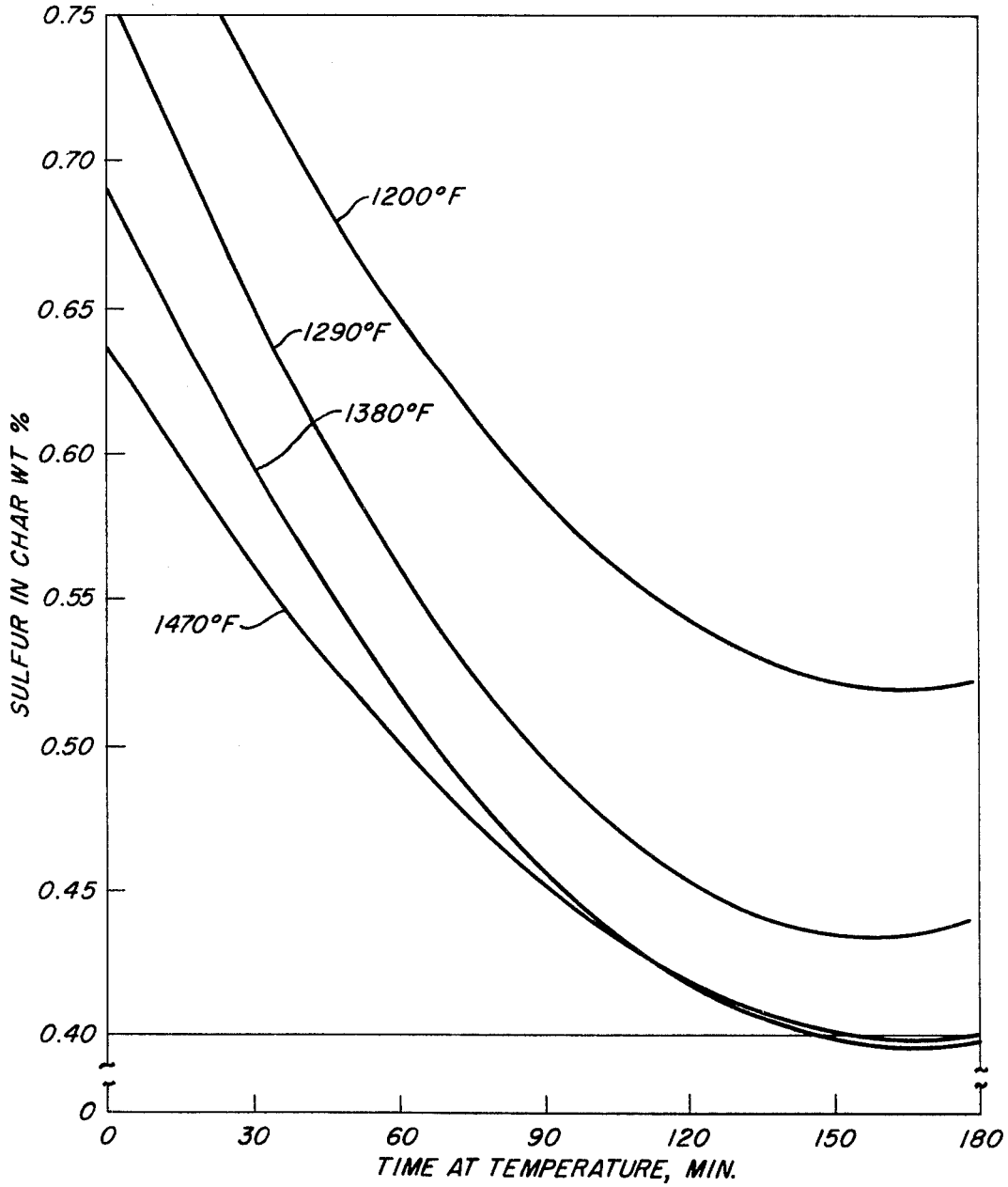
FIG. 4 illustrates the effect of temperature on residual sulfur content of char in a process as described in FIG. 3.

It has been found that as the rate at which the coal is heated up to the carbonization temperature is increased, the rate of desulfurization will be increased. In tabular form this is shown in Table IV as follows. For Table III, the charge was 100% coal. FIG. 4 illustrates the results for a charge of 50% coal/50% char (0.52% S). It can be seen that the mixture of coal and char gives better results than coal alone. Moreover, there appears to be a further desulfurization of the char when it is mixed with coal and subjected to carbonization and desulfurization under a hydrogen atmosphere.

The results are graphically displayed in FIG. 5 for a temperature of 1290° F and 1380° F, in which percent sulfur evolution is plotted as a function of temperature.

In the fluidized carbonization and desulfurization section of this invention, a mixture of coal and char is being subjected to carbonization and desulfurization. The increased rates of desulfurization by selection of appropriate temperature and rate of heat-up is important because it has been reported in the literature that char in the presence of coal has its desulfurization inhibited, see *Desulfurization Kinetics of Coal,* SRIC 69-10, Scientific Research Instruments Corporation, M. L. Vestal and W. H. Johnston, June 1969, Pages 2, 3, 56, 56, and 57.

A primary advantage of the carbonization process of this invention is the production of low sulfur char which may be used for formation of good metallurgical coke. It is preferred to obtain this char product without catalysts or the presence of inorganic hydrogen sulfide acceptors, such as dolomite. These external materials tend to increase the cost of the overall process as well as leaving inorganic residues that increase the ash content of the char and subsequently impair the metallurgical coke obtained from the char. As previously discussed, the increased ash content of the coke is undesirable.

As well as using a mixture of char and coal in the fluidized bed carbonization, heavy residual hydrocarbon oil may be injected into the carbonization process and the oil will crack into its residual coke constituents and middle oils. For example, at 1150° F and a residence time of 135 minutes, up to 30% or more of the heavy oil may be recovered as char. By combining heavy oil with char and coal, the amount of heavy oil which would otherwise need to be disposed of in other areas of the process is reduced.

Coal liquefaction is the rendering of coal into more useful liquids and gases by causing an increase in the hydrogen to carbon ratio of the original coal. The techniques of liquefaction are described in detail in U.S. Pat. No. 3,755,136 based on the co-pending application of Fields and Meyer, filed Mar. 12, 1971, entitled "System for Removing Solids from Coal Liquefaction Reactor Effluents", which disclosure is incorporated herein for reference. Most of the original solid carbon material in the coal is converted into organic liquids through this liquefaction process. It can be operated primarily for the production of liquid fuels such as gasoline; however, it is more desirable and more efficient to convert the coal into other organic chemicals such as tar acids and tar bases, light oils and benzenoid aromatics which have a higher economic value than the gasoline.

This invention may use any of the coal liquefaction processes currently in use, e.g., using a pure hydrocarbon liquid such as decahydronaphthalene to extract from the coal hydrogenatable materials and then subjecting this extract to gaseous hydrogen. It may also use a hydrogen rich slurry oil, slurried with coal, which slurry is subjected to an atmosphere containing hydrogen gas which in some cases causes hydrogen transfer to the coal from the hydrogen gas, or in other cases causes hydrogen transfer to the slurry oil which then transfers hydrogen to the coal. Also, solid coal itself may be subjected to the action of hydrogen gas, however, this has been a very inefficient method for liquifying the coal.

Figure 6:
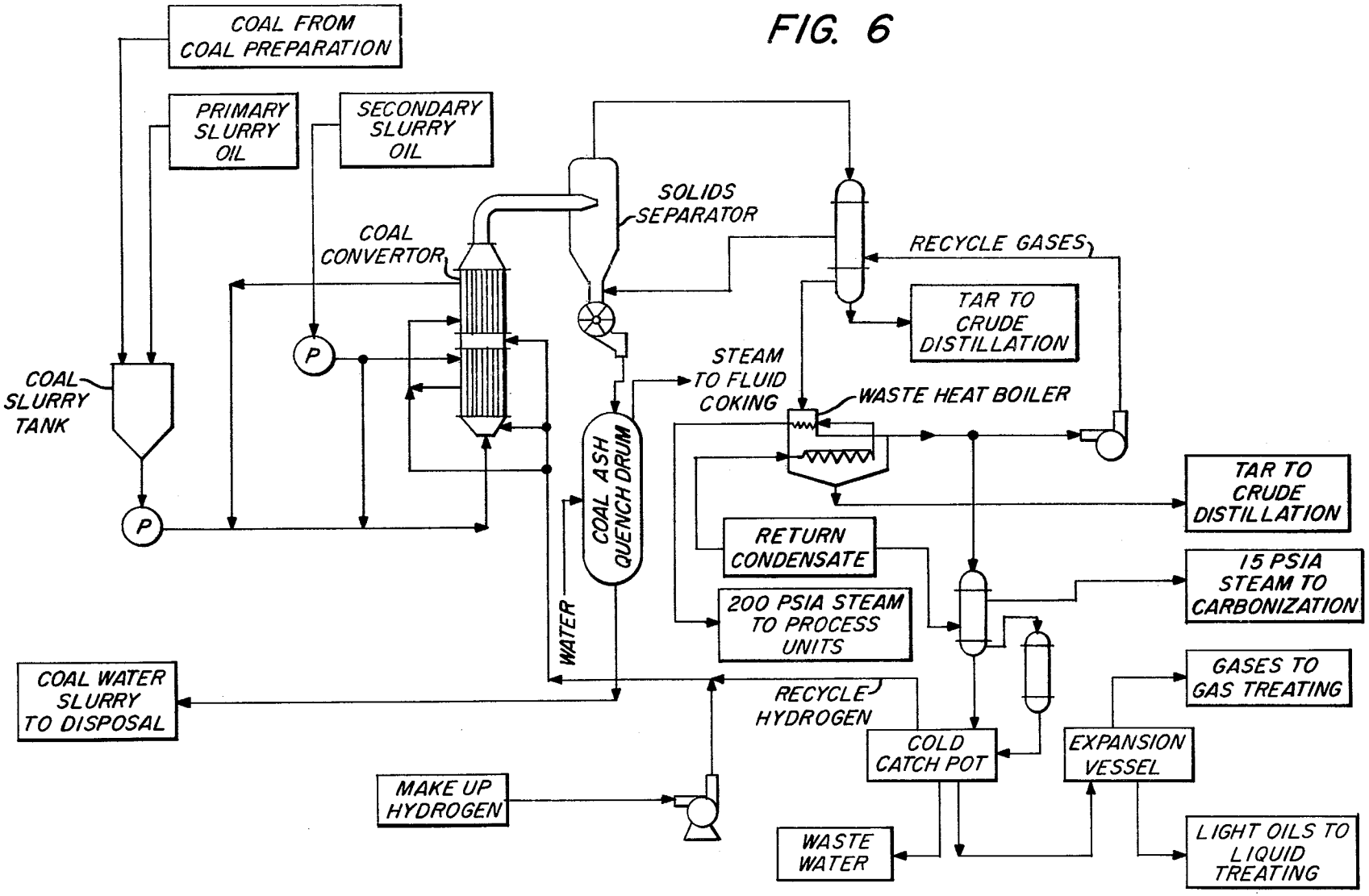
FIG. 6 is a flow diagram illustrating a coal liquefaction process according to the invention.

In FIG. 6 is a flow diagram of a liquefaction process especially suitable for the practice of this invention. Dry coal, having a particle size preferably of at least an eighth of an inch and up to one inch, is mixed with hot slurry oil. This oil may be obtained from the liquid treating section. The coal and oil may be mixed in proportions of about one part of oil with from one to about two and one half parts of coal or higher. The oil and coal are held in coal slurry tanks. This mixture is held for a sufficient time to provide partial digestion of the coal in the oil; 10 minutes is ordinarily sufficient at temperatures of about 430° F. The more particularly digested slurry is then pumped at a pressure of from 2000 to 10,000 psi by plunger type pumps to the liquefaction reactor. Additional slurry oil may also be pumped up to the pressure of the coal slurry and heated by being fed to the heat exchanger sections in the coal converter where it would be preheated to about 850° F by the reaction mass in the converter. This additional slurry oil is mixed with the original slurry and fed to the coal converter. In the coal converter there may be several interconnected reaction zones and gaseous inlet zones by which hydrogen is added. There may be a first reaction zone followed by a heat exchange zone in which heat generated by the liquefaction is removed by the countercurrent flow of coal slurry oil. Then, a second reaction zone in which more hydrogen is added to the reaction mass and last a final heat exchange zone where heat is again transferred to partially preheated slurry oil. Because the reaction of liquefaction, essentially hydrogenation, is highly exothermic, the temperature of the reaction mass rises rapidly as the liquefaction occurs. It is desirable to maintain the reaction zones in the coal converter at an approximately constant level, this may be from 800° to 960° F. Heat exchange between the reaction mass and the slurry oil provides a means by which the temperature of the coal converter can be kept constant as well as a means by which the heat of reaction from the liquefaction is used to heat slurry oil for digestion of the coal. If the hydrogen is fed concurrently with the coal, then at the end of the reaction zone the liquefaction will be proceeding at a decreased rate because of the partial depletion of the hydrogen supply as well as the degree of conversion of the coal.

The reaction effluent, which is a combination of solid, liquid and gaseous material, leaves the coal converter and goes to a solid separator. Various means may be used to separate the unreacted coal and ash residues from the gases and liquids produced in the coal liquefaction. Commonly, this is done by steam distillation, centrifugation, or filtration. It is especially desirable to separate the gases and liquids from the solid residues by means of vapor stripping in the presence of hydrogen. While vapor stripping alone is suitable, this vapor stripping may be done in combination with distillation, centrifugation or filtration by either preparing a solid-liquid stream for these operations or treating the solid-liquid slurries formed in these operations. This vaporization process may also be used to obtain a partially vaporized liquid slurry as well as for the production of a dry or liquid free solid residue which approximates the unreacted coal and ash content of the material fed into the coal converter.

In the separator there may be a first stage in which gaseous products are separated from the liquid-solid mixture. Th vapor stripping of the liquid-solid mixture may occur by direct contact with countercurrent flows of recycled gases exiting from the solid separator. Finally, the concentrated slurry at close to 50% solids may have its final liquid residues removed by vaporization in a second contacting stage with recycled gas. Dry solids discharge from the dryers to air locks and then into a closed quench drum where they may be cooled with water. Unreacted coal may be used as a fuel source for electric power generation. The vapors from the solid separation section are collected and have their entrained solids removed.

The combined product vapors and recycled gases will then be cooled and condensed to produce final streams to be refined in the liquid and gas treatment sections of the overall process as well as recycle streams for use in liquefaction. Initially, the vapors may be cooled to about 750° F in the gas interchanger. About 60% of the slurry oil and heavy oil in the vapor stream will condense in this stage of cooling. This condensate is sent to the crude distillation unit of the liquids treating section. The uncondensed vapors and gases are then cooled to 370° F in a waste heat boiler. Essentially all of the remaining slurry oil and high boiling oils plus about half of the low boiling tar acids are condensed here. The heat removed in the waste heat boiler generates 185 psig steam for use elsewhere in the plant. The condensate from the waste heat boiler is sent to the crude distillation unit of the liquids treating section.

The uncondensed stream from the waste heat boiler consists primarily of hydrogen and lighter reaction products. It is divided into two streams; one steam is recycle gas for the solids separator and the other is the final product gas stream that contains the lowest boiling reaction products and the excess hydrogen. The separator recycled gas is compressed to from 4600 to 4800 psig and heated to 950° F for reuse in the solids separator. The final product gas stream undergoes two additional stages of cooling and condensation. First, it is cooled in another waste heat boiler by generating 15 psig steam for use in the coal carbonization section. Finally the remaining gases and vapors are cooled in a final condenser cooler to 140° F. Condensate from the cooler and in the waste heat boiler are then combined in a cold catch pot. The temprature and pressure of the cold catch pot is such that all of the gases except hydrogen will dissolve in the condensed light oils. Water that was condensed with light oils is decanted and the light oils are adiabatically expanded to a pressure of about 115 psia. At this pressure, the dissolved gases (mainly methane) and light hydrocarbon products are released from the light oils at a flash temperature of 50° F. The gas stream is sent to gas treatment and the light oils are sent to the tar acid processing section of liquids treatment section.

The uncondensed gas product of the cold catch pot will contain about 95% of hydrogen and is suitable for recycle to the coal liquefaction stage. This recycle hydrogen is compressed to about 5,000 psia and combined with incoming makeup hydrogen from the gas treatment section. This makeup hydrogen can be made entirely by selection of the operarting conditions in the coal carbonization and desulfurization. It is a particular advantage of the process of this invention that such hydrogen may be produced along with a low sulfur char suitable for metallurgical coke in the coal carbonization and desulfurization. As well, by the vapor liquid stripping in the solid separation section of this coal liquefaction section, improved yields of chemical oils are obtained which make the overall carbonization and coal liquefaction sections especially suitable for use in combination. While the hydrogen may be fed directly into the coal converters, it may also be combined with slurry oils and used to cool the coal converter and thus to prevent coking of the slurry oil as its temperature approaches that of the reaction mass undergoing the liquefaction.

It is a particularly useful method of operation of the coal liquefaction to dispense with the use of external catalysts. Moreover, eliminating external catalysts also obviates the need for their removal from the reaction products of the coal liquefaction. Thus, the preferred operation of the coal converter is without the presence of catalyst. Finally, the heavy oils obtained from the coal liquefaction section may be used along with heavy oils obtained in other sections of the process as recycle oil to the coal carbonization section or in formation of green coke materials or they may be subsequently coked to produce additional coke and light oil.

The gas streams generated from the carbonization, liquefaction, liquid treatment, coke preparation section are combined and sent to the gas cleaning section. Coolers for each of the individual streams are included in the respective sections to cool the gas down to 100° F. In the liquefaction section, a gas stream originates from an adiabatic expansion at 50° F and therefore need not be cooled. The combined stream entering the gas treatment section may be at 90 psia. The particular temperature and pressure of the gas stream is a function of available equipment and the components to be used in the gas treatment section. For example, this gas may be at a pressure as high as 300 psia in order to eliminate compression in the gas treatment section.

Figure 7:
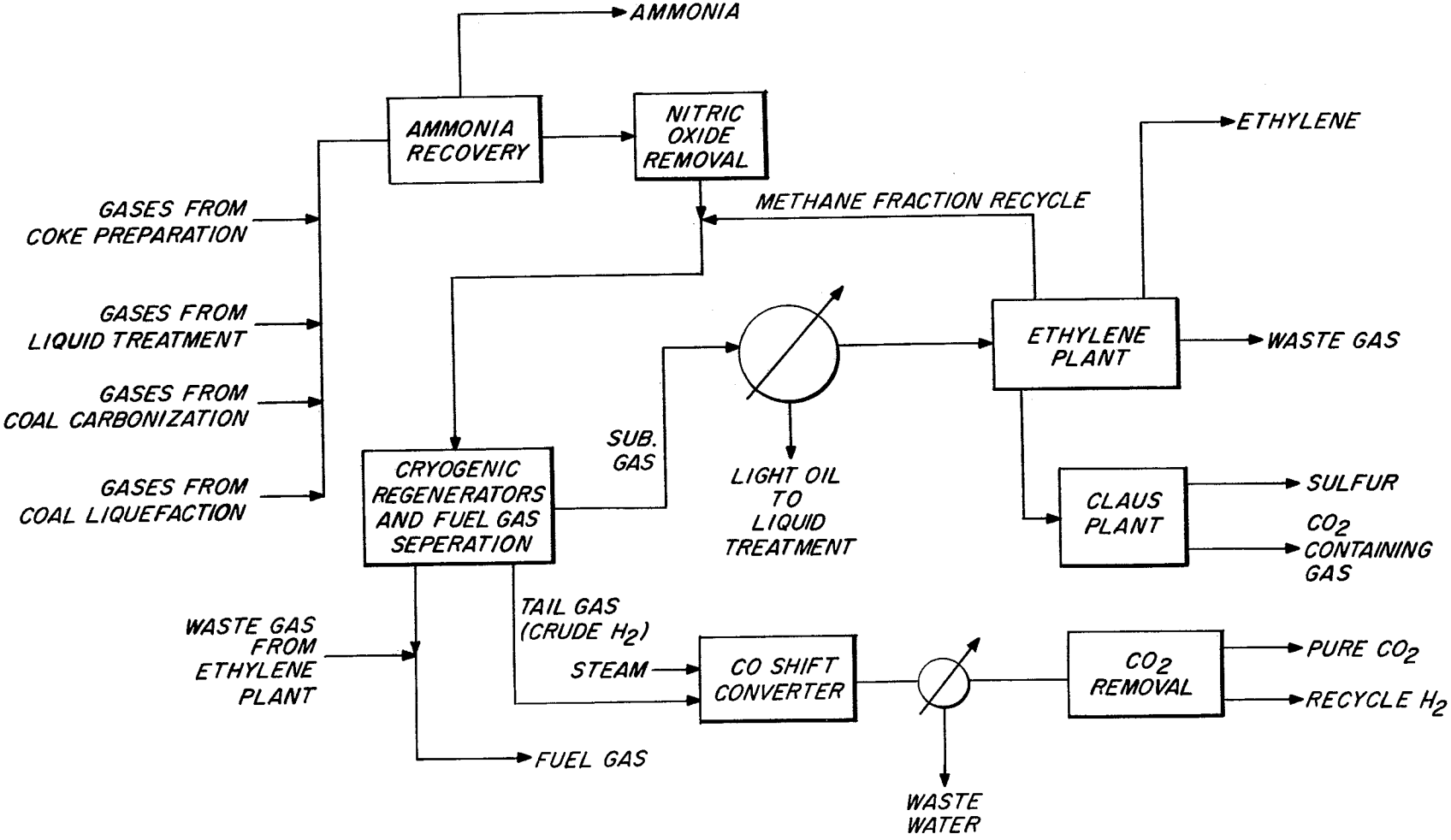
FIG. 7 is a flow diagram illustrating the recovery of gases according to the invention.

In FIG. 7, a flow diagram of the gas treatment section is illustrated. The combined gas stream first passes through an ammonia recovery unit where 99.5% of the ammonia in the feed stream is removed. The initial stream may contain as much as 3% ammonia by volume. This ammonia may be removed by absorption in an aqueous phosphate solution. Steam is used to strip the ammonia from the phosphate solution, the ammonia thus produced is fractionated to yield an anhydrous ammonia.

The gas from the ammonia recovery unit is then subjected to removal of nitric oxide which may be present in the gas stream. These nitric oxides may be removed by conventional methods such as treating the gas stream with air or oxygen.

The combined gas stram may be passed through a cryogenic separator and fuel gas separation unit in which light oil, methane, ethylene, and acid gases are condensed. The residual gases may be further cooled to remove methane and to produce a hydrogen rich gas stream containing carbon monoxide and methane. This gas stream is heated and compressed to 300 psia and sent to the carbon monoxide shift converters. The methane fraction from the cryogenic processing section is combined with the waste gas stream from the ethylene plant to form a fuel gas stream. A portion of this fuel gas will be consumed in the process of this invention and the remainder will be available as by-product fuel gas for disposal as a source of energy in conventional fuel gas heating applications. Light oil, methane, ethylene, and acid gases are sublimed to form a gas sublimation stream sub-gas and then may be cooled to 100° F to condense the light oil fraction. The light oil fraction may then be pumped to the liquid treatment section.

Noncondensables from the light oil condensation are sent to an ethylene plant. Acid gases in this stream, e.g., carbon dioxide, and hydrogen sulfide are removed by scrubbing with hot carbonate solution. The scrubged gas is subjected to catalytic hydrogenation whereby the contained acetylene is converted to ethylene. Methane, hydrogen, and carbon monoxide are removed from this gas stream and may be recycled for combination with the gas stream from the ammonia recovery section. Ethylene is separated from methane and the heavier hydrocarbons. Bottoms from the ethylene fractionation may be cracked to produce ethylene. The remaining gas obtained from the ethylene plant is added to the methane fraction leaving the cryogenic processing section which combination forms a fuel gas stream.

The acid gas stream from the ethylene plant is sent to Claus plant where hydrogen sulfide is converted into sulfur.

The feed stream to the carbon monoxide shift converter is reacted with steam to form hydrogen and carbon dioxide from the carbon monoxide contained therein. This reaction may be performed in the presence of an iron oxide catalyst at temperatures of about 300° F and pressures of about 300 psia. The gas is further cooled and then subjected to a hot potassium carbonate wash which removes any hydrogen sulfide gas. Carbon dioxide is removed by absorption. The product gas will contain about 88% hydrogen and the remainder will be essentially methane, this can be used as a hydrogen supply for the coal liquefaction section and for hydrogenation in the liquid treatment section. The carbon dioxide obtained by this method is essentially pure $CO_2$. The production of this pure carbon dioxide stream is a unique feature of this invention.

The hydrogen rich stream from the carbon dioxide absorbers is used to satisfy the hydrogen demand in the coal liquefaction and the liquid treatment sections of the invention. The initial coal streams from the coal preparation section may be fed to the carbonization section to provide a zero hydrogen balance on the overall process. However, the fuel gas produced in the process may be reformed with steam to yield additional hydrogen. There is enough fuel gas available after satisfying the process heating needs to obtain sufficient hydrogen by steam reforming so that only 30% of the total coal need be fed to the carbonization section. This percentage can be decreased even further if it is desired to increase the amount of chemical products produced or to improve the quality of the coke obtained from this process.

In the Claus plant, the feed stream may contain as much as 75% carbon dioxide and 25% hydrogen sulfide. One third of it may be fed to hydrogen sulfide combustion, while two thirds of it may be reacted with the combustion effluent to yield sulfur and a $CO_2$ containing gas. This gives good process control.

Figure 8:
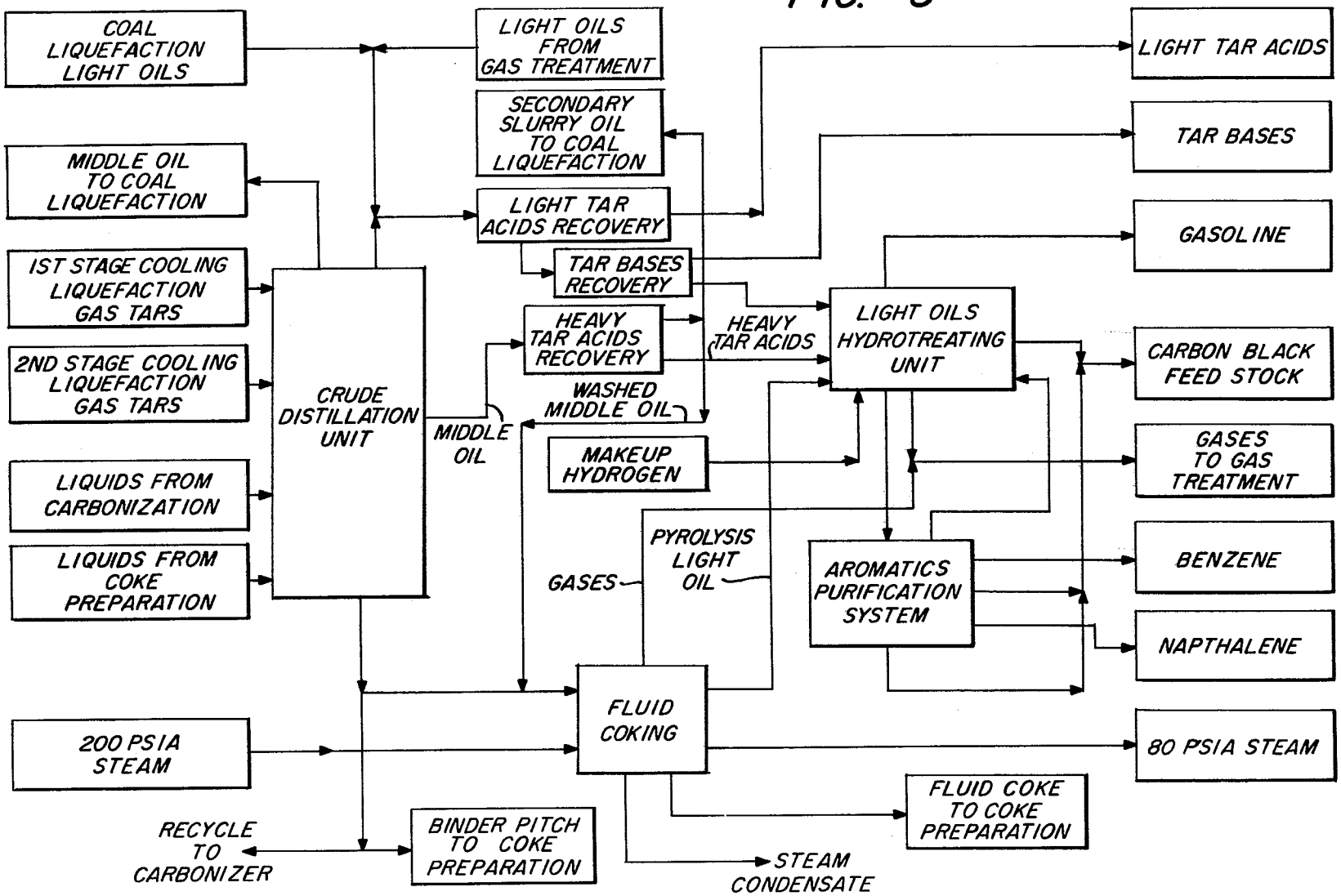
FIG. 8 is a flow diagram illustrating the recovery of liquids according to the invention.

The liquid treating section combines various units of conventional liquid processing such as distillation and hydrogenation and extraction techniques. The product mix of organic chemicals obtained as the end result of this section is subject to the choice of techniques used in the liquid treatment section. A wide variety of conventional liquid processing techniques permit the selection of those liquid products which are deemed most economical. In the illustration of FIG. 8, a liqid treating process in shown which is intended to provide for the maximum recovery of valuable organic liquids such as the benzenoid aromatics, the tar acids and the tar bases and which will minimize disposal problems of low value, heavy hydrocarbon liquid obtained in the process of this invention. As the desirability of the various end products and their proportions in the final product mix change, so also may the processing techniques in the liquid treating section be varied to accommodate these objectives.

The crude distillation unit is shown with four separate liquid feed streams. Each of these liquid streams requires somewhat different preliminary treatment. Tars obtained from the first stage of gas cooling in the coal liquefaction reaction is available at temperatures of about 750° F and about 2,000 psia. This stream is flashed to about 200 psia in order to degas the significant amounts of volatiles forced into the liquid. A second flashing to about 20 psia will vaporize all the middle boiling range material which will be at a temperature of about 590° F. Condensation of the middle oil vapors can produce 350 psia steam for use in the gas treating section shift converter carbon monoxide. The hot condensed middle oil is recycled directly to the liquefaction as coal slurry oil. Hot bottoms from this vaporization may be set to a fluid coking unit.

The second feed stream is obtained from the second stage of gas cooling in the coal liquefaction. This stream like that above is composed predominantly of slurry oil, but it also contains about 40% of light tar acid products from the liquefaction, essentially all of the heavy tar acids, and half of the waste water. This stream also will be subject to multiple expansions in order to release its contained gases. First stage expansion to about 500 psia would release most of the gases, but essentially none of the waste water. Waste water may be decanted from the immiscible organic tars. The further expansion to about 200 psia would release the remainder of the dissolved gases. Light tar acids, about 1.5% of the total tar acids, may be recovered in the light tar acid recovery unit by steam stripping. Middle oil and heavy oil fractions from the flashed tar may be recovered by vacuum distillation.

The remaining feed streams—coal carbonization tar and recycle liquids from coke preparation (partially decomposed heavy oil) may be combined and subjected to tar topping. Light oil is removed from the distillate. Bottoms may be subjected to vacuum distillation. The heavy oils from this vacuum distillation may be used as a binder for char and coke preparation, or they may be fed to a fluid coking unit, or they may be recycled to the carbonization section where they are mixed with char and coal for feed into the carbonization reactor.

Fluid coking is essentially a pyrolysis in which superheated steam is used both as a heat carrier and as a fluidizing gas. Hot heavy oils and washed middle oils may be mixed with a bottoms recycle from a fluid coking unit as a feed stream to the fluid coking unit. Steam at 1500° F is injected into the fluidized coking reactor. The coking cuases the heavy oils to crack and yield a low molecular weight gas with a high olefin content and a low molecular weight oil rich in benzene and other mononuclear aromatic compounds. Volatiles in the fluid coke may be controlled by the steam temperature and the length of time that the coke is in contact with the steam. As well, a simultaneous fluid coking may be performed under milder conditions, e.g. 925° F, to give a coke with a higher volatile content. The wet and dry cokes may then be blended to give a composite fluid coke product that can be set to a metallurgical coke production unit.

Fluidized steam and vaporized product from the fluid coking section may be used to produce 200 psia steam for re-use in the coking process. Other steam if required may be obtained from such sources as the waste heat boilers in the coal liquefaction section. Condensed organics from the fluidization off-gases may be sent to the liquid treatment section. The gas products may be sent to the gas treating section.

Tar acids may be recovered from middle oil and from a heavy tar acid overhead from crude distillation. Tar acid recovery is essentially extraction in the tar acid recovery unit to remove tar acids from light oil and middle oil in heavy hydrocarbon streams or condensed overhead streams. The heavy tar acids may be converted to benzene and naphthalene while the light tar acids may be separated in the fractionator into phenol, xylenols and cresols. Tar bases may be recovered in a liquid contactor by treating light oil with monopyridinium sulfate. Purification will yield aniline while the alkyl anilines may be added to light oil for dealkylation to benzene and ammonia.

The light oils hydrotreating unit is also capable of producing a wide range of products within the context of the overall liquid treatment. One example of the product selectivity available with this light oil hydrotreating is to maximize the production of benzene while still producing a high octane motor gasoline. Hydrotreating will generally involve separation of the light oil into reformer feedstocks enriched in lower boiling saturated hydrocarbons and a hydrocracker feed enriched in aromatics. Reforming of the naphthenics content of the saturated enriched steam will provide aromatics and hydrogen. solvent extraction of a benzene-rich aromatics fraction from the reformed stream will yield a high octane gasoline as raffinate. The dealkylation and hydrocracking of the aromatic rich streams will produce benzene and naphthalene.

Heavy tar acids can be subjected to extractive distillation in the presence of light oils. Aromatic hydrocarbons tend to concentrate in the tar acids. The overhead will contain almost all of the saturated hydrocarbons in the gasoline boiling range (350° F, end point) and essentially no aromatics with a higher boiling point than xylene (292° F). The distillate will be predominantly naphthenic in character.

The aromatics are purified at the recovery unit to release high purity benzene and naphthalene. Distillate from extractive distillation will contain approximately 25% aromatics, 60% cycloparaffins (naphthene) and 15% paraffins. It is subjected first to hydrodesulfurization and then the naphthenes are reformed to aromatics. A liquid butane stream for gasoline blending may be obtained as the overhead. Effluent from reformer may be subjected to solvent extraction in which the raffinate will be a high octane gasoline containing about 40% aromatics and about 25% cycloparaffins. Extract from this solvent extraction in the bottoms from the extractive distillation may be hydrocracked and dealkylated. Hydrocracking converts essentially all of the nonaromatic constituents to light hydrocarbon gases, mostly methane. This gas stream may be combined with gases obtained during the reforming and recycled to the gas treatment section. Alkylated aromatics are almost completely dealkylated to benzene and naphthalene. High boiling residual materials may be used as feedstock in the manufacture of carbon black.

The coke preparation secton combines char from the carbonization section with a binder such as heavy petroleum liquid, and optionally coke fines, to produce the green product from which metallurgical grade coke is ultimately obtained. The essential constituent of this metallurgical grade coke is, however, the low sulfur char obtained in the carbonization section. It is desirable that the metallurgical grade coke not only have the ash and sulfur contents previously discussed but also that it be an easily handled material and that it has sufficient mechanical strength to support the burden in the blast furnace.

Figure 9:
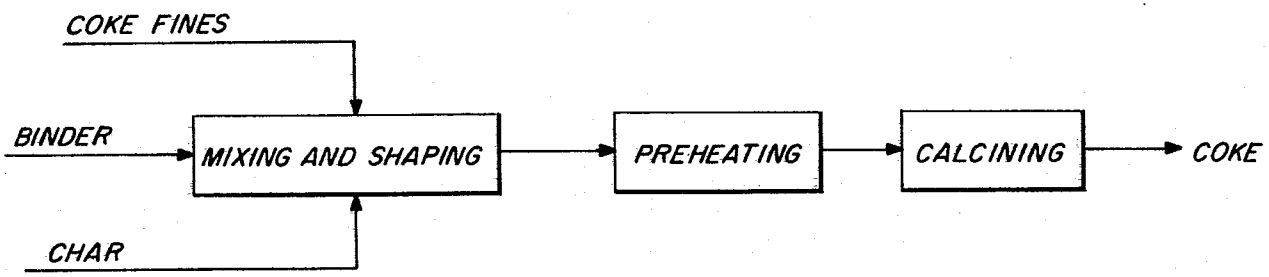
FIG. 9 is a flow diagram illustrating the production of metallurgical coke according to the invention.

FIG. 9 illustrates the production of metallurgical grade coke from char, coke fines such as fluid coke, and heavy oil generated in the process of this invention. Char may be mixed with coke fines and oil binders such as bottoms from the liquid treatment section or mixtures of heavy bottom oil and middle oil from the liquid treatment section and then sent to a forming unit to make green coke articles which are subsequently calcined to yield the final coke material. The char may be 50 to 90% by weight of the mixture. Binder may be 10 to 50% by weight of the mixture. Coke fines may be up to equal proportions of the char. Conventional methods of forming green coke material may be used. For instance, the combined char, fluid coke, and binder may be briquetted or pelletized or pressed into desired shapes. The coke may have a size of 1/16 to 3 inches in diameter. The green coke articles are then subjected to a preheating in which the articles have their mechanical strength increased so that they may be subjected to a more rigorous condition of the calcination process. These preheaters may operate at temperatures from 500° F to 900° F. After preheating the articles are then subjected to calcination which may occur at 1500°-2400° F. This will reduce the volatile matter content of the metallurgical coke to less than 5%. Hot gases emitted from the calcination and preheating sections are cooled and sent to the gas treatment section as previously explained. The final calcined product then may be used as metallurgical grade coke.

The following example illustrates how in the practice of our invention a given coal may be converted into final products under the specific conditions described.

EXAMPLE

From an initial stream of 1,419 M lbs/hr. of washed coal, containing 5.15% ash and 1.79% sulfur, a fraction is obtained for carbonization. This fraction of 617 M lbs/hr. is dried at 400° F to remove 52 M lbs/hr. of water and the dried coal (565 M lbs/hr.) is continuously fed to a fluid bed coal carbonizer and desulfurizer. In the carbonizer the dried coal mixes with char. The quantity of char in the carbonizer is about 800 M lbs. Initmate miking of coal and char is provided by the fluidized bed. By the combination of coal and char, free flowing bed properties are maintained so that efficient desulfurization of the coal is obtained.

In this example, coal is mixed with char by maintaining an inventory — hold up — of char product in the carbonizer. The amount of char to be retained in the carbonizer depends upon the rate of coal through-put and residence time as well as the desired degree of devolatilization and desulfurization of the coal. Generally, the smallest amount of char consistent with maintaining a free flowing bed of particles is desired. For this example, the residence time is 95 minutes, the carbonizer temperature is 950° F and the carbonizer pressure is 95 psia. Also introduced into the carbonizer is 214 M lbs/hr. of heavy hydrocarbon oil from a liquid treatment as illustrated in FIG. 8. This material is carbonized into additional char and light hydrocarbons and gases. The char from these heavy oils along with the char from the coal constitutes the product, which amounts to 486 M lbs/hr. This product, which is continuously withdrawn from the carbonizer, will have a volatile matter content of about 15% by weight, a sulfur content of 0.63% by weight and an ash content of 8.5% by weight.

This char will be mixed with about 203 M lbs/hr. of a heavy hydrocarbon oil (binder pitch) which is obtained from a liquid treatment as illustrated in FIG. 8. This mixture is then processed, as described in FIG. 9, into pellets of 1/16 inch to 3 inches diameter. These pellets are cured by heating in air at 500° F and then carbonized and devolatilized at 2,400° F to yield 547 M lbs/hr. of metallurgical-grade coke product suitable for use in a blast furnace.

The hot gases leaving the carbonization-desulfurization reactor are cooled to 100° F and washed with water to remove condensable tars. These tars about 121 M lbs/hr., contain light tar acids, heavy tar acids, tar bases, benzene, toluene, xylenes, anilines, indenes, coumarone, naphthalene, middle oil and heavy oil and may be sent to liquid treatment as illustrated in FIG. 8.

After separation of the tars, the remaining gases, about 1,612 M lbs/hr. are scrubbed with hot potassium carbonate solution to remove the $H_2S$ and thus provide a low-sulfur gas suitable for recycle to the carbonization-desulfurization reactor. About 1,450 M lbs/hr. are thus utilized as fluidizing gas. The surplus gas, about 120 M lbs/hr. and the acid gases, 42 M lbs/hr. (primarily $H_2S$ and $CO_2$), obtained from regenerating the fouled potassium carbonate solution, are sent to gas treating for processing. These two gas streams along with gases from coal liquefaction, liquid treatment, and coke preparation are processed in gas treatment as illustrated in FIG. 7.

From the initial washed coal stream, 802 M lbs/hr. are mixed with 1,450 M lbs/hr. of slurry oil which mixture is subjected to liquefaction by contact with hydrogen at about 900° F and 5,000 psia for about 40 minutes. The source of th hydrogen is the hydrogen gas from the cooled product gases of the coal liquefaction as illustrated in FIG. 6 together with 63.5 M lbs/hr. of a hydrogen containing gas from gas treatment as illustrated in FIG. 7. The reaction effluent is subjected to contact under a reducing atmosphere with a hydrogen containing gas at 950° F in a solids separator vessel at 5,000 psia for vaporization and removal of the gases and volatilizable liquids from the ash and unreacted coal. This unreacted coal and residual ahs amount to about 160 M lbs/hr., and may be used as a solid boiler fuel. The gas stream from the solids separation is cooled and depressurized in stages to provide tars, light oils, light hydrocarbon gases and recycle hydrogen. The tars, about 1,749 M lbs/hr., are principally heavy oil, boiling point above 750° F; middle oil, which is used as the slurry oil for the coal in the liquefaction, boiling point 450–750° F; and heavy tar acids. The light oil, 137 M lbs/hr., contains light tar acids, tar bases, benzene, toluene, xylene, aromatic solvents, anilines, and naphthalene. The tars and light oil are processed in the liquid-treatment section as described in FIG. 8.

When processed, the converted coal will yeild the following finished products:

| | M lbs/hr. |
|---|---|
| Ammonia | 8.5 |
| Sulfur | 11.5 |
| Ethylene | 88.3 |
| Benzene | 72.5 |
| Naphthalene | 27.8 |
| Propylene | 14.5 |
| Phenol | 14.6 |
| o-cresol | 5.4 |
| n-, p-cresols | 19.8 |
| Xylerols | 19.7 |
| Pyridines, picolines, and lutidines | 2.5 |
| Aniline and toluidines | 4.1 |
| Carbon black feedstock | 3.9 |
| Pure $CO_2$ | 99 |
| Fuel Gas | 132 |
| Metallurgical-Grade Coke | 547 |
| Power Plant Fuel | 160 |

The foregoing constitutes a description of the overall process and the ultimate products from our invention. As well, the means by which ultimate products are obtained from the feed materials have been set forth in detail. Variations of the processing techniques have been indicated as methods in which the overall process of converting a high sulfur containing coal by selecting predetermined fractions for carbonization and for coal liquefaction will result in the production of useful chemical liquids, gases, ad metallurgical grade coke. However, other modifications of this basic process may be performed within the scope of this invention.

We claim:

1. A method for the economical conversion of high sulfur coal to conversion products for the production of metallurgical grade coke and low sulfur gaseous and liquid fuels, wherein coal carbonization and liquefaction processes are integrated to treat particulate, high sulfur coal containing from about 1 to 5% sulfur, said method comprising, (a) in a fluidized bed reaction zone maintained at a carbonizing temperature not greater than 1600° F, contacting a first quantity of said particulate coal with (i) an amount of char at least sufficient to maintain the free flow of the bed of coal particles and (ii) a gas containing at least an amount of $H_2$ sufficient to yield a resultant low sulfur char containing less than 0.7% sulfur, said gas having no more than about 2% by volume $H_2S$ and being substantially free of $O_2$; the resultant carbonization reaction producing, in addition to said low sulfur char, gaseous effluents, and liquid effluents including tar acids and hydrocarbon oils, (b) in a liquefaction reaction zone maintained at a temperature of about 800° to 960° F and a pressure of 2000 to 10,000 psi, combining a second quantity of said particulate coal with carrier oil, a substantial portion of which is hydrocarbon middle oil derived from step (e), and reacting the combination in the presence of $H_2$ to render said second coal quantity into gaseous effluents, and liquid effluents including light-, middle-, and heavy-hydrocarbon oils, (c) recovering low sulfur char product and the gaseous and liquid effluents from steps (a) and (b), (d) recovering $H_2$ from said gaseous effluents and passing at least a portion of the recovered $H_2$ to said liquefaction reaction zone to satisfy the $H_2$ demands thereof, (e) recovering said hydrocarbon middle oil and passing at least a portion thereof to said liquefaction reaction zone to satisfy the carrier oil demands thereof, said hydrocarbon middle oil containing tar acids from said carbonization reaction for the promotion of said liquefaction reaction, (f) proportioning the ratios of coal fed to steps (a) and (b) so that said first quantity is between 30 and 65% of the sum of said first and second quantities; whereby heavy-hydrocarbon oil is produced in a quantity at least sufficient to serve as binder, for the low sulfur char recovered as product, in the formation of a green coke material, which, upon calcination at temperatures of 1500° to 2400° F will produce a metallurgical grade coke containing less than 0.7% S.

2. The method of claim 1, wherein a portion of the heavy hydrocarbon oils recovered from said liquid effluents are passed to step (a) for increasing the amount of low sulfur char recovered as product.

3. The method of claim 2, wherein said carbonization temperature is about 1250° to 1550° F.

4. The method of claim 3, wherein said first coal quantity is heated to said carbonization temperature at a rate equal to or greater than 144° F/min.

5. The method of claim 2, wherein the $H_2$ required in steps (a) and (b) is wholly obtained from said gaseous effluents.

6. The method of claim 5, wherein the carrier oil required in step (b) is wholly obtained from said recovered liquid effluents.

7. The method of claim 2, further comprising, admixing said low sulfur char recovered as product with said binder comprising heavy hydrocarbon oils, said binder being present in an amount of about 10 to 50%, by weight, of the resultant mixture; forming a green coke article from said mixture; calcining said article at a temperature of 1500° to 2400° F, and recovering an agglomerated metallurgical coke product containing less than 0.7% S.

* * * * *

UNITED STATES PATENT AND TRADEMARK OFFICE

CERTIFICATE OF CORRECTION

PATENT NO. : 4,094,746

DATED : June 13, 1978

INVENTOR(S) : Philip X. Masciantonio and Kenneth A. Schowalter

It is certified that error appears in the above-identified patent and that said Letters Patent are hereby corrected as shown below:

Column 1, line 44, "quantities of useful gases, and" should be -- quantities of useful gases, liquids, and --;

Column 3, lines 39 and 40, "distilled to yield oils" should be -- distilled to yield light oils --; (in application, page 6, line 26).

Column 5, line 10, "Curve D on Fig. 2" should be -- Curve D on Figure 1 --;

Column 7, line 34, Table IV, in footnote a), "temperatue" should be -- temperature --;

UNITED STATES PATENT AND TRADEMARK OFFICE

CERTIFICATE OF CORRECTION

PATENT NO. : 4,094,746

DATED : June 13, 1978

INVENTOR(S) : Philip X. Masciantonia and Kenneth A. Schowalter

It is certified that error appears in the above-identified patent and that said Letters Patent are hereby corrected as shown below:

Column 7, line 55, Table III, under the column entitled Conditions, and under Material Balance, "Gas & Loss, wt." should be -- Gas + loss, wt. % --;

Column 8, line 64, "56, and 57" should be -- 56A, and 57 --; (in application, page 17, line 12).

Column 8, line 1, "coal/-" should be -- coal/ --;

Column 9, lines 59 and 60, "The more particularly digested" should be -- The partially digested --;

Column 12, line 28, "gas stram" should be -- gas stream --; (in application, page 24, line 22).

Column 12, line 50, "scrubged" should be -- scrubbed --;

UNITED STATES PATENT AND TRADEMARK OFFICE

CERTIFICATE OF CORRECTION

PATENT NO. : 4,094,746

DATED : June 13, 1978

INVENTOR(S) : Philip X. Masciantonio and Kenneth A. Schowalter

It is certified that error appears in the above-identified patent and that said Letters Patent are hereby corrected as shown below:

Column 12, lines 62 and 63 "sent to Claus" should be -- sent to a Claus --;

Column 13, line 17, "section may be fed to the carbonization section" should read -- section may be separated into preselected fractions so that sufficient coal is fed to the carbonization section --;

Column 13, line 43, "process in shown" should be -- process is shown --;

Column 13, line 47, "liquid obtained" should be -- liquids obtained --;

UNITED STATES PATENT AND TRADEMARK OFFICE

CERTIFICATE OF CORRECTION

PATENT NO. : 4,094,746

DATED : June 13, 1978

INVENTOR(S) : Philip X. Masciantonio and Kenneth A. Schowalter

It is certified that error appears in the above-identified patent and that said Letters Patent are hereby corrected as shown below:

Column 13, line 58, "about 2,000 psia" should be -- about 2,000 to 10,000 psia --;

Column 13, line 68, "may be set" should be -- may be sent --;

Column 14, line 33, "cuases" should be -- causes --;

Column 16, line 30, "miking of coal" should be -- mixing of coal --;

Column 17, line 20, "of th hydrogen" should be -- of the hydrogen --;

Column 17, line 29, "residual ahs amount" should be -- residual ash amount --:

UNITED STATES PATENT AND TRADEMARK OFFICE

CERTIFICATE OF CORRECTION

PATENT NO. : 4,094,746

DATED : June 13, 1978

INVENTOR(S) : Philip K. Masciantonio and Kenneth A. Schowalter

It is certified that error appears in the above-identified patent and that said Letters Patent are hereby corrected as shown below:

Column 17, line 41, "will yeild" should be -- will yield --;

Column 17, line 53, "Xylerols" should be -- Xylenols --;

Signed and Sealed this

*Sixth* Day of *February 1979*

[SEAL]

*Attest:*

RUTH C. MASON
*Attesting Officer*

DONALD W. BANNER
*Commissioner of Patents and Trademarks*